US007944459B2

(12) United States Patent
Miyazawa

(10) Patent No.: US 7,944,459 B2
(45) Date of Patent: May 17, 2011

(54) LIGHT-EMITTING DEVICE, DRIVING CIRCUIT, DRIVING METHOD, ELECTRONIC APPARATUS, AND IMAGE FORMING APPARATUS

(75) Inventor: Takao Miyazawa, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 1287 days.

(21) Appl. No.: 11/470,920

(22) Filed: Sep. 7, 2006

(65) Prior Publication Data

US 2007/0109231 A1 May 17, 2007

(30) Foreign Application Priority Data

Nov. 14, 2005 (JP) ..... 2005-328487

(51) Int. Cl.
*G09G 5/10* (2006.01)

(52) U.S. Cl. ..... 345/691; 345/690; 345/76; 345/77; 345/78

(58) Field of Classification Search ..... 345/690–691, 345/76–78
See application file for complete search history.

(56) References Cited

U.S. PATENT DOCUMENTS 5,999,150 A * 12/1999 Nighan et al. ..... 345/79

FOREIGN PATENT DOCUMENTS

| | | |
|---|---|---|
| JP | A-03-120059 | 5/1991 |
| JP | A-2001-042458 | 2/2001 |
| JP | 2001-284044 | * 10/2001 |
| JP | A 2002-361924 | 12/2002 |
| JP | A 2003-334990 | 11/2003 |
| JP | A-2003-341124 | 12/2003 |

* cited by examiner

*Primary Examiner* — Richard Hjerpe
*Assistant Examiner* — Leonid Shapiro
(74) *Attorney, Agent, or Firm* — Oliff & Berridge PLC

(57) ABSTRACT

A light-emitting device includes a plurality of light-emitting elements, each emitting light with a light amount according to a driving signal, a storage unit that stores first gray-scale data for assigning a gray-scale value of each of the plurality of light-emitting elements, a data processing unit that generates second gray-scale data from the first gray-scale data stored in the storage unit for each light-emitting element such that, as the gray-scale value assigned by the first gray-scale data is large, a gray-scale value assigned by the second gray-scale data is made small, and a driving unit that causes the individual light-emitting elements to emit light in a first period upon supply of a driving signal according to the first gray-scale data stored in the storage unit, and causes the individual light-emitting elements to emit light in a second period different from the first period upon supply of a driving signal according to the second gray-scale data generated by the data processing unit.

18 Claims, 9 Drawing Sheets

LIGHT-EMITTING DEVICE, DRIVING CIRCUIT, DRIVING METHOD, ELECTRONIC APPARATUS, AND IMAGE FORMING APPARATUS

BACKGROUND

1. Technical Field

The present invention relates to a technique that controls the light amount of a light-emitting element, such as an organic light-emitting diode (hereinafter, referred to as 'OLED').

2. Related Art

A light-emitting device having a plurality of light-emitting elements arranged therein is used as an exposure head that exposes a photosensitive member so as to form a latent image or a display device that displays various images. The characteristics of such a light-emitting element are being degraded according to a degree of light-emission in the past (for example, the number of times of light-emission) as time passes. In the light-emitting device, the degree of light-emission of each of the light-emitting elements varies according to the shape of an image or a gray-scale level, and thus a variation in characteristic of each light-emitting element (for example, light-emission efficiency) occurs. In particular, when a plurality of images having a common shape are successively output (for example, in an image forming apparatus using a light-emitting device as an exposure head, when the same image is printed in quantity), the variation in characteristic of each light-emitting element is expanding as time passes.

In order to solve the variation in characteristic due to a time-variant degradation of each light-emitting element, for example, JP-A-2003-334990 or JP-A-2002-361924 discloses a technique that causes each light-emitting element to emit light additionally according to the number of times of light-emission of each light-emitting element in the past. According to this technique, the sum of the number of times of light-emission is made uniform, for a plurality of light-emitting elements, and thus the variation in characteristic of each light-emitting element or luminance irregularity can be suppressed.

However, in the technique disclosed in JP-A-2003-334990 or JP-A-2002-361924, in order to hold the number of times of light-emission in each of the plurality of light-emitting elements in the past, a mass storage device is required. Accordingly, the circuit size of the light-emitting device becomes large, and manufacturing costs are increased when the total number of the light-emitting elements or the number of gray-scale levels for a high-definition image, the number of data (the number of times of light-emission) or the number of digits stored in the storage device needs to be increased, and thus the above problem becomes more critical.

An advantage of some aspects of the invention is that it reduces a storage capacity required for suppressing a variation in characteristic of each light-emitting element.

According to a first aspect of the invention, a light-emitting device includes a plurality of light-emitting elements, each emitting light with a light amount according to a driving signal, a storage unit (for example, a storage unit 44 of FIG. 3) that stores first gray-scale data for assigning a gray-scale value of each of the plurality of light-emitting elements, a data processing unit (for example, a data processing unit 45 of FIG. 3) that generates second gray-scale data from the first gray-scale data stored in the storage unit for each light-emitting element such that, as the gray-scale value assigned by the first gray-scale data is large, a gray-scale value assigned by the second gray-scale data is made small, and a driving unit (for example, a driving circuit 30 of FIG. 1) that causes the individual light-emitting elements to emit light in a first period upon supply of a driving signal according to the first gray-scale data stored in the storage unit, and causes the individual light-emitting elements to emit light in a second period different from the first period upon supply of a driving signal according to the second gray-scale data generated by the data processing unit.

According to the first aspect of the invention, the second gray-scale data is generated from the first gray-scale data of each light-emitting element such that the larger the gray-scale value of the first gray-scale data is, the smaller the gray-scale value of the second gray-scale data is. Further, each light-emitting element is driven on the basis of the first gray-scale data in the first period, and is driven on the basis of the second gray-scale data in the second period. According to this configuration, a degree of light-emission of each light-emitting element is made uniform over the plurality of light-emitting elements, as compared with a case where each light-emitting element is driven on the basis of only the first gray-scale data. Therefore, a variation in light amount of each light-emitting element due to a time-variant degradation can be suppressed. Besides, according to the first aspect of the invention, the degrees of light-emission by the first gray-scale data and the second gray-scale data are not necessarily completely matched with each other for each light-emitting element.

Moreover, the light-emitting elements herein are parts for radiating light. More specifically, the light-emitting elements are elements that emit light upon application of electrical energy. The specific structure or material of the light-emitting element herein is arbitrarily selected. For example, an element having electrodes and a light-emitting layer formed of an organic EL material or an inorganic EL material interposed between the electrodes can be used as the light-emitting element of the invention. In addition, various light-emitting elements, such as an LED (Light Emitting Diode) element, an element that emits light by plasma discharge, and so on can be used in the invention Further, the driving signal is specified by, for example, a level (current value or voltage value) and a pulse width (that is, the driving signal has a level component and a pulse width component). 'The light amount according to driving signal' herein is a light amount according to the level of the driving signal or a light amount according to the pulse width of the driving signal.

In the invention, 'such that the larger the gray-scale value assigned by the first gray-scale data is, the smaller the gray-scale value assigned by the second gray-scale data becomes' means that, paying attention to specified gray-scale values g1*a* and g1*b* among all the gray-scale values to be assigned by the first gray-scale data (however, g1*a*<g1*b*), a gray-scale value g2*a* of the second gray-scale data generated from the first gray-scale data having a gray-scale value g1*a* is larger than a gray-scale value g2*b* of the second gray-scale data generated from the first gray-scale data having a gray-scale value g1*b* (g2*a*>g2*b*). As regards all the gray-scale values assigned by the first gray-scale data and all the gray-scale values assigned by the second gray-scale data generated by the first-gray scale data, the same relationship is not necessarily established. For example, as described above, when g1*b* is larger than g1*a* ('g1*a*<g1*b*'), if the relationship 'g2*a*>g2*b*' is established, it still falls within the scope of the invention, regardless of the relationship between a certain gray-scale value g1*c* assigned by the first gray-scale data (≠g1*a* and g1*b*) and a gray-scale value g2*c* of the second gray-scale data generated on the basis of the gray-scale value g1*c*.

According to a specific aspect of the invention, the first period (for example, a first period $P_1$ of FIG. 2) is a period where an image (for example, a visual image) according to light-emission by each light-emitting element may be output, and the second period (for example, a second period $P_2$ of FIG. 2) is a period where the image according to light-emission by each light-emitting element is not output. According to this configuration, light emission in the second period does not have an effect on the visual image to be formed in the first period, and thus a desired image can be formed with high quality.

According to a specific aspect of the invention, the second period may be shorter than the first period. According to this configuration, as compared with the configuration that the first period and the second period have the same time length, a time length that can be originally used to form an image in the first period can be secured relatively long. Therefore, the image can be efficiently formed.

In the above aspects, a specific configuration for making the second period shorter than the first period is arbitrarily selected. For example, the total number of the light-emitting elements that actually emit light in the second period may be made smaller than the total number of the light-emitting elements that emit light in the first period, and thus the second period may have a time length shorter than the first period. However, according to a preferred aspect of the invention, the driving signal supplied to each light-emitting element may become a level (current value or voltage value) for causing the light-emitting element to emit light by a pulse width according to the first gray-scale data of a first unit period (for example, a unit period $U_1$ of FIG. 2 or FIG. 4) in the first period, and may become a level for causing the light-emitting element to emit light by a pulse width according to the second gray-scale data of a second unit period (for example, a unit period $U_2$ of FIG. 2 or FIG. 4) shorter than the first unit period in the second period. That is, a pulse width (for example, a pulse width Wb of FIG. 7) of the driving signal having a predetermined gray-scale value assigned by the second gray-scale data is shorter than a pulse width (for example, a pulse width Wa of FIG. 7) of the driving signal having the predetermined gray-scale value assigned by the first gray-scale data. According to this configuration, since the second unit period is set to have the time length shorter than the first unit period, for example, when all the light-emitting elements that are driven in the first period are driven in the second period, the second period can be reliably made shorter than the first period.

However, if the level of the driving signal is set to the first period and the second period, and the second unit period is set to have a time length shorter than the first period, there is a possibility that degrees of light-emission of each light-emitting element in the first period and the second period are different from each other. According to a preferred aspect of the invention, the driving signal supplied to each light-emitting element may become a level (for example, an on current value Ia of FIG. 7) for causing the light-emitting element to emit light with a first light amount (for example, an intensity La of FIG. 7) in a pulse width according to the first gray-scale data of the first unit period, and may become a level (for example, an on current value Ib of FIG. 7) for causing the light-emitting element to emit light with a second light amount (for example, intensity Lb of FIG. 7) larger than the first amount in a pulse width according to the second gray-scale data of the second unit period. According to this configuration, the degree of light-emission of each light-emitting element can be made uniform over the first period and the second period with high accuracy.

By the way, among the light-emitting elements, there may be an element that has different states of the time-variant change in characteristic when the level of the driving signal is fixed and the pulse width is changed, and when the pulse width of the driving signal is fixed and the level is changed. In the light-emitting device that uses such a light-emitting element, the pulse width and the level of the driving signal according to the second gray-scale data are set such that the state of the time-variant change in characteristic of the light-emitting element when the driving signal according to the second gray-scale data assigning a predetermined gray-scale value may be supplied approximately matches with the state of the time-variant change in characteristic of the light-emitting element when the driving signal according to the first gray-scale data assigning the predetermined gray-scale value is supplied. According to this configuration, a speed of time-variant characteristic degradation of each light-emitting element can be made uniform for the plurality of light-emitting elements.

Moreover, 'the state of the time-variant change in characteristic of the light-emitting element' means the relationship between a time elapsed from a time point at which the light-emitting element is produced (or a time elapsed from a time point at which the use of the light-emitting device starts) and the characteristic of the light-emitting element. In general, it is a characteristic change speed of the light-emitting element. Further, lifespan representing a time until a characteristic value (for example, a light amount when a predetermined gray-scale level is assigned) of the light-emitting element is lowered to a predetermined value corresponds to the state of the change in characteristic of the light-emitting element in the invention. The characteristic of the light-emitting element includes, for example, a light amount of the light-emitting element when a predetermined gray-scale value is assigned or a relative ratio (light-emission efficiency) between the value of a current supplied to the light-emitting element and a light amount at that time.

For example, a time-variant lowering speed of the light amount of each light-emitting element, such as an OLED element, may be approximately in proportion to the pulse width of the driving signal and to an M power (where M is a real number) of the level of the driving signal. In the configuration that uses such a light-emitting element, the light-emitting element having a predetermined gray-scale value assigned by the first gray-scale data emits light with a light amount La upon supply of a driving signal having a pulse width Wa, the level of the driving signal according to the second gray-scale data may be determined such that a light amount Lb of the light-emitting element to which a driving signal having a pulse width Wa/u (where u>1) according to the second gray-scale data assigning the predetermined gray-scale value satisfies the equation $Lb/La=u^{1/M}$. Alternatively, when the light-emitting element having a predetermined gray-scale value assigned by the first gray-scale data emits light with a light amount La upon supply of a driving signal having a pulse width Wa, a pulse width Wb of a driving signal that has a level determined so as to cause the light-emitting element to emit light with a light amount La×v (where v>1) according to the second gray-scale data assigning the predetermined gray-scale value may satisfy the equation $Wb/Wa=v^{-M}$.

The light-emitting device according to the aspect of the invention is used in various electronic apparatuses. As the electronic apparatus, there is an image forming apparatus that has the light-emitting device according to the aspect of the invention as an exposure device (an exposure head). The image forming apparatus includes an image carrier having an image formation surface, on which a latent image is formed on an image formation surface by exposure, the light-emitting device according to the aspect of the invention that exposes the image formation surface, and a developing device that attaches a developing agent (for example, a toner) to the latent image so as to form an apparent image. In the light-emitting device according to the aspect of the invention, irregularity of the light amount (gray-scale level) of each light-emitting element can be suppressed for a long period. Therefore, according to the image forming apparatus using the light-emitting device, uniform-quality images can be formed on recording mediums for a long period.

According to a specific aspect of the image forming apparatus, the first period may be a period where a developing device forms an apparent image from a latent image formed on an image carrier by light-emission of each light-emitting element in that period, and the second period may be a period, a gap between previous and next first periods, where the apparent image according to light-emission of each light-emitting element is not formed in that period. According to this configuration, since light-emission in the second period does not have an effect on the visual image to be formed in the first period, a desired image can be formed with high quality. Moreover, a configuration for causing the visual image (apparent image) according to light-emission by each light-emitting element not to be formed in the second period is arbitrarily selected. For example, a configuration for causing a developing agent not to be attached to a latent image formed on a photosensitive member by light-emission of each light-emitting element in the second period may be selected. Alternatively, a configuration for causing the latent image not to be formed on the photosensitive member by light-emission of each light-emitting element in the second period (for example, causing the photosensitive member not to be charged in the second period) may be selected.

Besides, the use of the light-emitting device according to the invention is not limited to exposure. For example, the light-emitting device according to the aspect of the invention can be used as display devices of various electronic apparatuses. Such an electronic apparatus includes, for example, a personal computer or a cellular phone. Further, the light-emitting device according to the aspect of the invention is suitably used as various illumination devices, such as a device that is disposed at the back of a liquid crystal device and illuminates the liquid crystal device (backlight) or a device that is mounted on an image reading apparatus, such as a scanner or the like, and irradiates light onto an original.

Another aspect of the invention is also specified as a circuit for driving a light-emitting device (a driving circuit 30 and a controller 40 of FIG. 1). A driving circuit for a light-emitting device, which has a plurality of light-emitting elements, each emitting light with a light amount according to a driving signal, includes a storage unit that stores first gray-scale data for assigning a gray-scale value of each of the plurality of light-emitting elements, a data processing unit that generates second gray-scale data from the first gray-scale data stored in the storage unit for each light-emitting element such that the larger the gray-scale value assigned by the first gray-scale data is, the smaller a gray-scale value assigned by the second gray-scale data becomes, and a driving unit that causes each light-emitting element to emit light upon supply of a driving signal according to the first gray-scale data stored in the storage unfit in a first period, and causes each light-emitting element to emit light upon supply of a driving signal according to the second gray-scale data generated by the data processing unit in a second period different from the first period. According to this driving circuit, a storage capacity of the storage unit can be reduced, and a variation in characteristic of each light-emitting element can be suppressed.

Another aspect of the invention is also specified as a method of driving a light-emitting device. A method of driving a light-emitting device, which has a plurality of light-emitting elements each emitting light with a light amount according to a driving signal, includes acquiring first gray-scale data assigning a gray-scale value of each of the plurality of light-emitting elements, generating second gray-scale data from the acquired first gray-scale data for each light-emitting element such that, as the gray-scale value assigned by the first gray-scale data is large, the gray-scale value assigned by the second gray-scale data is made small, and causing each light-emitting element to emit light upon supply of a driving signal according to the acquired first gray-scale data in a first period, and causing each light-emitting element to emit light upon supply of a driving signal according to the generated second gray-scale data in a second period different from the first period. According to this driving method, the same effects as those in the light-emitting device according to the aspect of the invention can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

<A: Configuration of Light-Emitting Device>

The configuration of a light-emitting device according to an embodiment of the invention will be described. The light-emitting device is an exposure head that exposes a photosensitive member, such as a photosensitive drum or the like, and forms a latent image (electrostatic latent image) on a surface of the photosensitive member. In this embodiment, it is assumed that a latent image having pixels of vertical m row× horizontal n columns is formed (where m and n are natural numbers).

Figure 1:
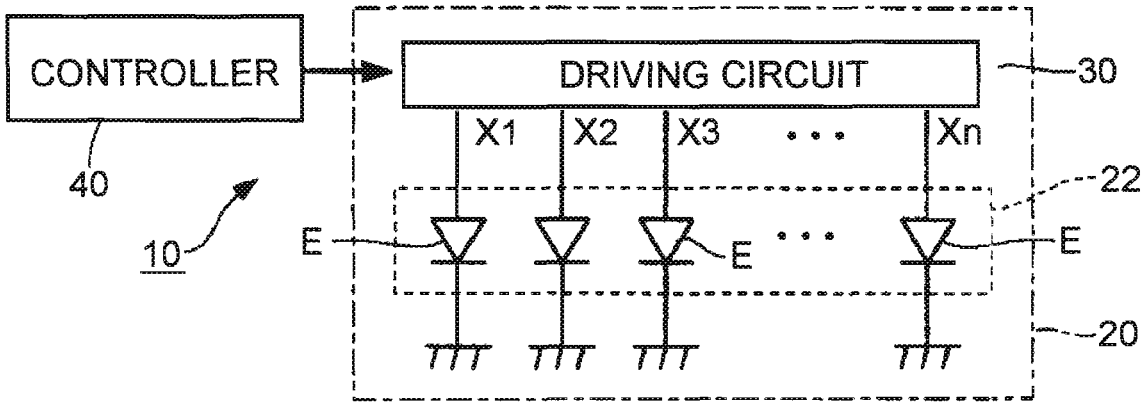
FIG. 1 is a block diagram showing the configuration of a light-emitting device according to an embodiment of the invention.

FIG. 1 is a block diagram showing the configuration of a light-emitting device of this embodiment. As shown in FIG. 1, a light-emitting device 10 includes a head module 20 that radiates a light beam according to a desired image onto a photosensitive member (not shown), and a controller 40 that controls the operation of the head module 20.

The head module 20 includes a light-emitting unit 72 and a driving circuit 30. In the light-emitting unit 22, n light-emitting elements E are linearly arranged along a main scanning direction. The light-emitting elements E correspond to n pixels constituting each row of the image. In this embodiment, each of the light-emitting elements E is an OLED element that has an anode and a cathode, and a light-emitting layer formed of an organic electroluminescent interposed between the anode and the cathode.

The driving circuit 30 causes the n light-emitting elements E to emit light according to the supply of driving signals X1 to Xn. The driving signal Xj that is supplied to the light-emitting element E of the j-th column (where j is an integer satisfying the condition $1 \leqq j \leqq n$) keeps a current value (hereinafter, referred to as 'on current value Ion') for causing the light-emitting element E over a time length according to a gray-scale value assigned to the light-emitting element E in a predetermined period (hereinafter, referred to as 'unit period'). In the remaining period of the unit period, the driving signal Xj becomes zero. Moreover, the driving circuit 30 may have a plurality of IC chips each driving the predetermined number of light-emitting elements E or may have a single IC chip driving all the light-emitting elements E. Further, the driving circuit 30 may have thin film transistors. In this configuration, the light-emitting elements E and the driving circuit 30 are integrally incorporated into a surface of a substrate formed of an insulating material, such as glass or the like.

Figure 2:
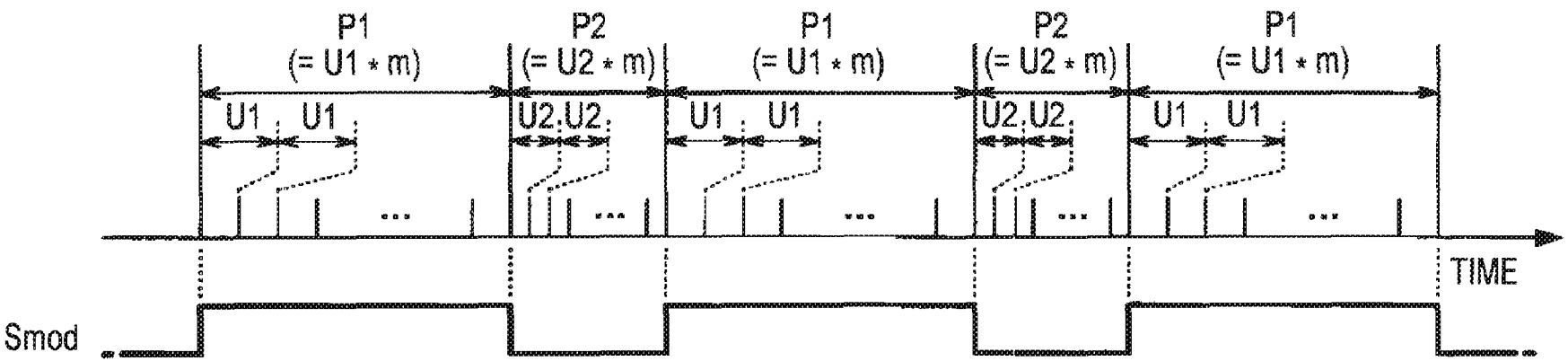
FIG. 2 is a conceptual view showing the relationship between a first period $P_1$ and a second period $P_2$.

As shown in FIG. 2, a period where the light-emitting device 10 operates is divided into a plurality of first periods $P_1$ and a plurality of second period $P_2$ that are respectively interposed between the first period $P_1$. Each of the first periods $P_1$ is a period where an image for one page according to light-emission of each light-emitting element E in that period is actually formed on a recording medium, such as a paper or the like, and then output. As shown in FIG. 2, one first period $P_1$ includes m unit periods $U_1$. When the photosensitive member sequentially steps forward in a sub-scanning direction for each unit period $U_1$, a latent image for one page of vertical m rows×horizontal n columns is formed on the surface of the photosensitive member for each first period $P_1$. Meanwhile, the second period $P_2$ is a period where, even though each light-emitting element E emits light in that period, an image according to light-emission is not output to the outside (a so-called paper interval). One second period $P_2$ includes m unit periods $U_2$.

In each of the unit period $U_1$ of the first period $P_1$, a degree of light-emission of each light-emitting element E varies according to an image content (a gray-scale value of each pixel). Therefore, if each light-emitting element E is allowed to emit light in only the first period $P_1$, a degree of time-variant characteristic degradation varies for each light-emitting element E, and thus a variation in light amount (luminance) of each light-emitting element E occurs. In this embodiment, in order to prevent the variation, in the second period $P_2$, each light-emitting element E is allowed to emit light at luminance having inverted high and low levels with respect to those in the first period $P_1$. For example, the j-th light-emitting element E is allowed to emit light at high luminance in the i-th (where i is an integer satisfying the condition $1 \leqq i \leqq m$) unit period $U_1$ of the first period $P_1$, while the j-th light-emitting element E is allowed to emit light at low luminance in the i-th unit period $U_2$ of the second period $P_2$. According to this configuration, in the first period $P_1$ and the second period $P_2$ immediately after the first period $P_1$, the degree of light-emission of each light-emitting element E (and a degree of degradation of each light-emitting element E according to light-emission) can be made uniform over n light-emitting elements E, regardless of the image content. Moreover, since the second period $P_2$ is a period where the image is not output to the outside, light-emission of the light-emitting element E in the second period $P_2$ does not nave effect on the image to be formed on the recording medium in the first period $P_1$.

Figure 3:
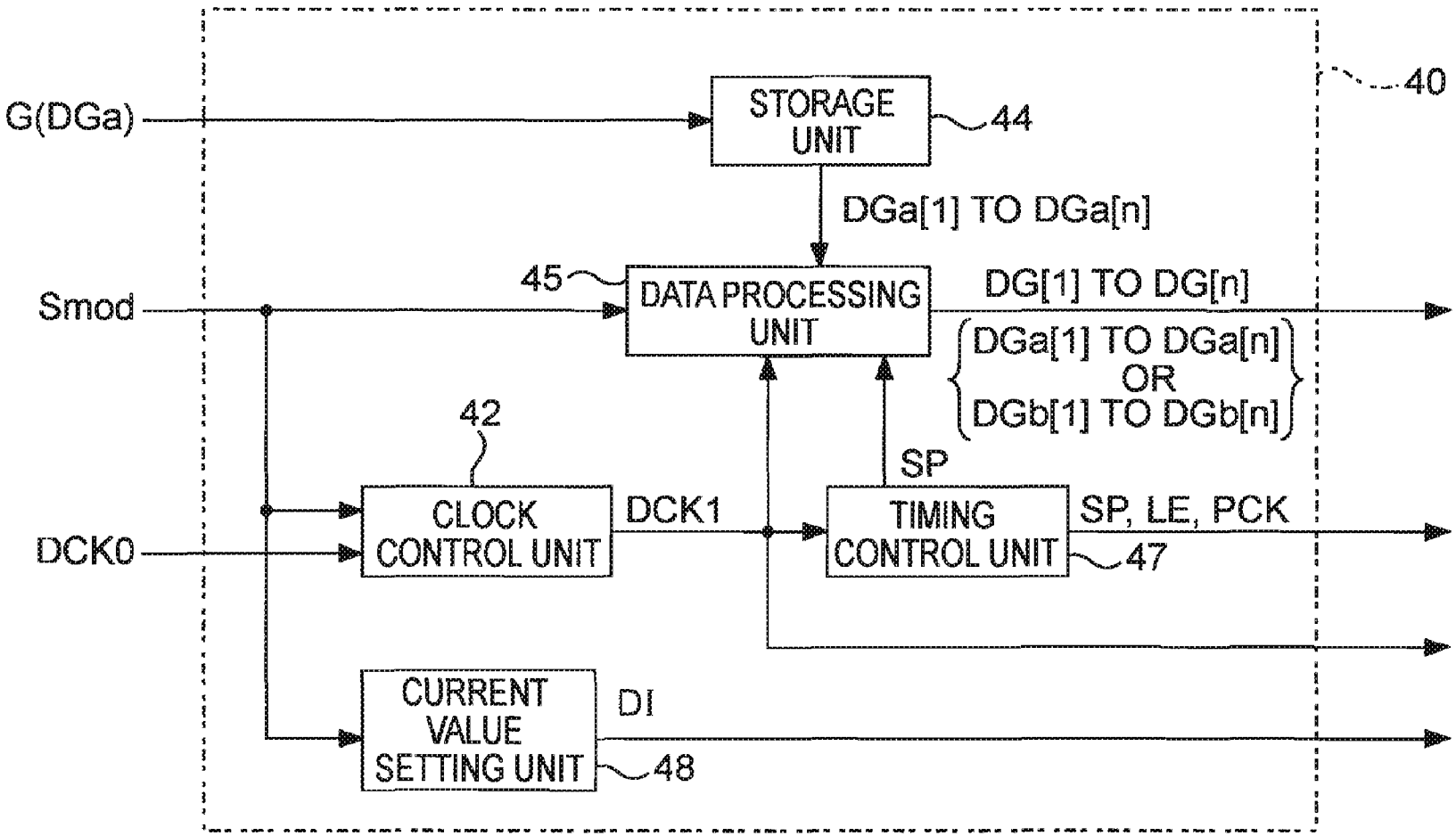
FIG. 3 is a block diagram showing the specific configuration of a controller.

FIG. 3 is a block diagram showing the specific configuration of the controller 40. As shown in FIG. 3, a clock signal DCK0, a mode signal Smod, and image data G are supplied to the controller 40 from various host devices, such as a CPU (Central Processing Unit) of an image forming apparatus, on which the light-emitting device 10 is mounted. The clock signal DCK0 is a signal having a cycle $t_c$1 for defining a dot clock. The mode signal Smod is a signal for distinguishing the first period $P_1$ and the second period $P_2$. In this embodiment, as shown in FIG. 2, the mode signal Smod is kept at a high level in the first period $P_1$ and is kept at a low level in the second period $P_2$.

The image data G includes a plurality ('m×n') of first gray-scale data DGa that defines gray-scale values of the pixels of vertical m rows×horizontal n columns included in the image for one page. The first gray-scale data DGa is sequentially input to the controller 40 at a timing synchronized to the clock signal DCK0. The first gray-scale data DGa corresponding to one pixel is 4-bit digital data for defining the gray-scale value of the pixel to any one of 16 levels ('0' to '15'). Moreover, the number of bits of the gray-scale data (the first gray-scale data DGa or second gray-scale data DGb to be described below) is arbitrarily set. For example, the number of bits may be six or eight.

As shown in FIG. 3, the controller 40 includes a clock control unit 42, a storage unit 44, a data processing unit 45, a timing control unit 47, and a current value setting unit 48. The image data G is supplied to the storage unit 44. The clock signal DCK0 is supplied to the clock control unit 42. The mode signal Smod is supplied to the clock control unit 42, the data processing unit 45, and the current value setting unit 48. Moreover, the individual parts constituting the controller 40 may be implemented by hardware, such as DSP (Digital Signal Processor) or the like, or may be implemented by causing a computer, such as a CPU (Central Processing Unit) or the like, to execute a program.

Figure 4:
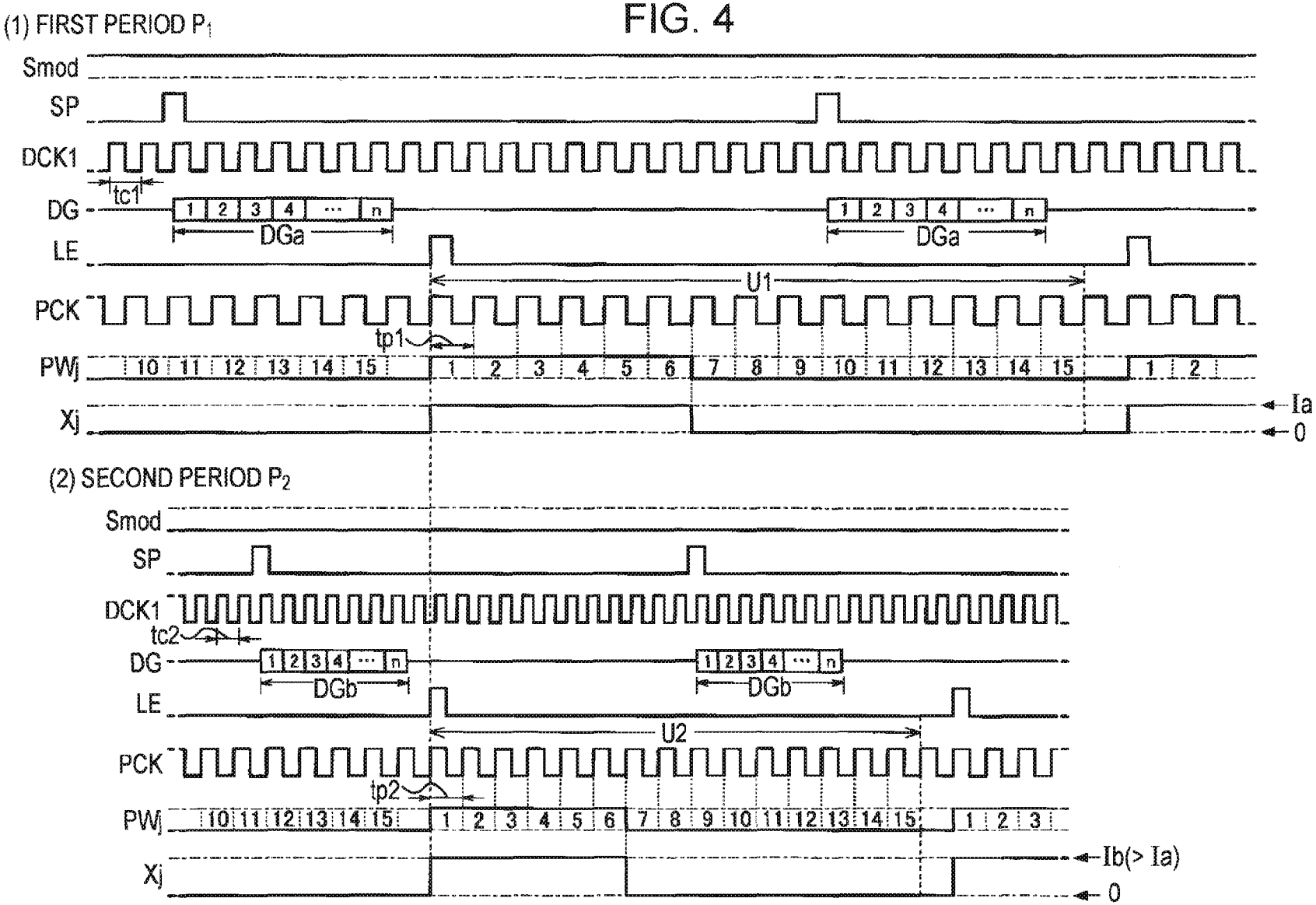
FIG. 4 is a timing chart showing the relationship between gray-scale data DS[j] and a driving signal X[j].

FIG. 4 is a timing chart illustrating the operation of the light-emitting device (in particular, the controller 40). In a portion (1) of FIG. 4, the states of the individual signals in the first period $P_1$ are illustrated, and, in a portion (2) of FIG. 4, the states of the individual signals in the second period $P_2$ are illustrated. Hereinafter, the specific configuration of the controller and the functions of individual parts thereof will be described with reference to FIGS. 3 and 4.

The clock control unit 42 generates and outputs a clock signal DCK1 having a cycle according to the mode signal Smod from the clock signal DCK0. As shown in the portion (1) of FIG. 4, in the first period $P_1$ where the mode signal Smod is kept at the high level, the clock control unit 42 outputs the clock signal DCK0 as the clock signal DCK1 (cycle $t_c$1) as it is. Meanwhile, as shown in the portion (2) of FIG. 4, in the second period $P_2$ where the mode signal Smod is kept at the low level, the clock control unit 42 generates and outputs the clock signal DCK1 having a cycle $t_c$2 ($t_c$2<$t_c$1) shorter than the cycle $t_c$1 of the clock signal DCK0.

As shown in FIG. 3, the clock signal DCK1 output from the clock control unit 42 is output to the timing control unit 47, the data processing unit 45, and the driving circuit 30 of the head module 20. The individual parts operate at a timing synchronized to the clock signal DCK1. Since the cycle $t_c$2 of the clock signal DCK1 in the second period $P_2$ is shorter than the cycle $t_c$1 in the first period $P_1$, the operation cycle of the timing control unit 47, the data processing unit 45, or the driving circuit 30 is shorter in the second period $P_2$ than in the first period $P_1$. Therefore, as shown in FIG. 2, the second period $P_2$ is made shorter than the first period $P_1$. The operation in the second period $P_2$ is not directly involved in an original use of the light-emitting device 10 (image formation). In this embodiment, since the second period $P_2$ is shorter than the first period $P_1$, an image output can be effectively performed, and thus a printing speed can be improved, as compared with a case where the first period $P_1$ and the second period $P_2$ have the same time length.

The storage unit 44 of FIG. 3 is a device (a buffer memory) that stores the image data G (the first gray-scale data DGa) to be supplied from a host device. In this embodiment, the storage unit 44 stores image data G of an image for one page. The first gray-scale data DGa corresponding to one pixel is four bits, and thus the capacity of the storage unit 44 becomes '4 (bits)×m (rows)×n (columns)'.

The data processing unit 45 outputs n gray-scale data DG (DG[1] to DG[n]) for assigning the gray-scale values of the individual light-emitting elements E to the driving circuit 30 on the basis of the image data G stored in the storage unit 44 and the mode signal Smod to be supplied from the host device. The n gray-scale data DG (DG[1] to DG[n]) is sequentially output to the driving circuit 30 in synchronization with the clock signal DCK1 to be supplied from the clock control unit 42. The operation of the data processing unit 45 will be described in detail below.

The data processing unit 45 reads the n first gray-scale data DGa (DG[1] to DGa[n]) corresponding to each row among the image data G stored in the storage unit 44 for each unit period U ($U_1$ or $U_2$) of the first period $P_1$ or the second period $P_2$. For example, in each of the first period $P_1$ and the second period $P_2$, n first gray-scale data DGa (DGa[1] to DGa[n]) corresponding to the i-th row of the image in the i-th unit period U is read in parallel.

In the first period $P_1$ where the mode signal Smod is kept at the high level, as shown in the portion (1) of FIG. 4 the data processing unit 45 outputs the n first gray-scale data DGa (DGa[1] to DGa[n]) read from the storage unit 44 to the driving circuit 30 as gray-scale data DG (DG[1] to DG[n]) as it is. In contrast, in the second period $P_2$ where the mode signal Smod is kept at the low level, as shown in the portion (2) of FIG. 4, the data processing unit 45 generates n second gray-scale data DGb (DGb[1] to DGb[n]) from the n first gray-scale data DGa (DGa[1] to DGa[n]) read from the storage unit 44, and outputs the second gray-scale data DGb (DGb[1] to DGb[n]) to the driving circuit 30 as the gray-scale data DG (DG[1] to DG[n]).

The second gray-scale data DGb[j] generated in the i-th unit period $U_2$ of the second period $P_2$ is data for assigning a gray-scale value having inverted high and low levels (density of a gray-scale level) with respect to the first gray-scale data DGa[j] of the pixel of the i-th row and the j-th column. That is, the data processing unit 45 generates the second gray-scale data DC-b[j] from the first gray-scale data DGa[j] such that the larger the gray-scale value of the first gray-scale data DGa[j] read from the storage unit 44 is, the smaller the gray-scale value of the second gray-scale data DGb[j] is (the smaller the gray-scale value of the first gray-scale data DGa[j] is, the smaller the gray-scale value of the second gray-scale data DGb[j] is). More specifically, the data processing unit 45 generates 4-bit data, which is obtained by inverting all the bits (4 bits) of the first gray-scale data DGa[j] as the second gray-scale data DGb[j]. For example, when the first gray-scale data DGa[j] is "0110" in binary notation ('6' in decimal notation), the data processing unit 45 generates "1001" obtained by inverting the individual bits ('9' in decimal notation) as the second gray-scale data DGb[j]. Therefore, like the first gray-scale data DGa[j], the second gray-scale data DGb [j] is four-bit data for assigning any one of 16 gray-scale values in total.

The timing control unit 47 of FIG. 3 generates various signals for defining an operation timing of the driving circuit 30 on the basis of the clock signal DCK1. In this embodiment, the timing control unit 47 generates a light-emission enable signal LE, a start pulse SP, and a pulse width defining clock PCK. A cycle of each signal varies in the first period $P_1$ and the second period $P_2$ as the cycle of the clock signal DCK1 changes.

As shown in the portions (1) and (2) of FIG. 4, the light-emission enable signal LE is a pulse signal that rises at a timing of a start portion of the unit period U ($U_1$ or $U_2$). The start pulse SP is a pulse signal that rises before the rising timing of the light-emission enable signal LE by a predetermined period. As shown in the portions (1) and (2) of FIG. 4, in a period from a rising edge of the start pulse SP to a rising edge of the light-emission enable signal LE, the gray-scale data DG (DG[1] to DG[n]) for one row (n gray-scale data) is output from the data processing unit 45 to the driving circuit 30. That is, a period from the rising edge of the start pulse SP to the rising edge of the light-emission enable signal LE is set longer than n cycles of the clock signal DCK1.

Figure 5:
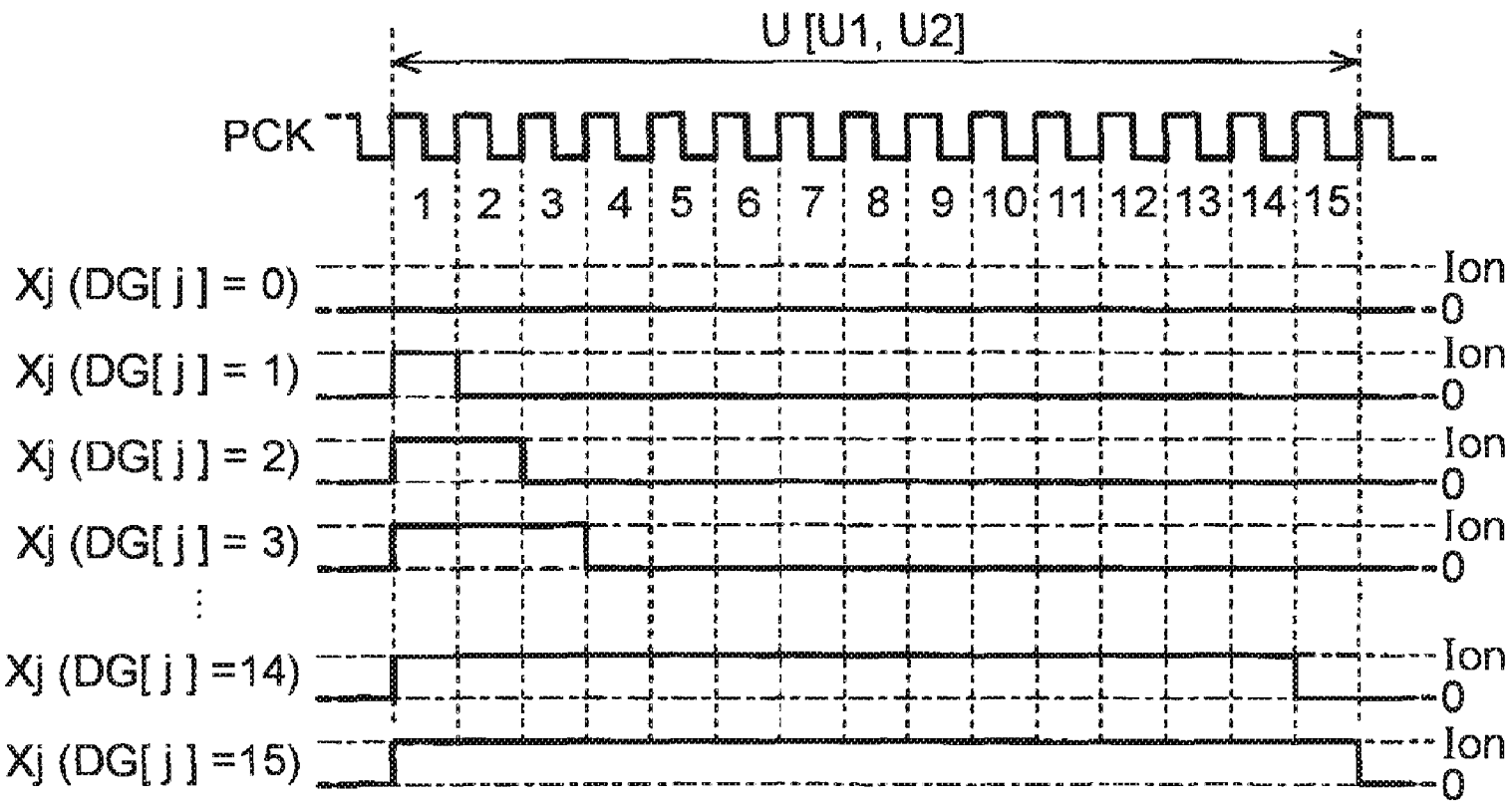
FIG. 5 is a timing chart illustrating the operation of a light-emitting device.

The pulse width defining clock PCK is a clock signal for defining a timing at which a current value of the driving signal Xj is switched. FIG. 5 is a timing chart showing the relationship between the gray-scale value assigned by the gray-scale data DG[j] (DGa[j] or DGb[j]) output from the controller 40 and the driving signal Xj to be supplied to the light-emitting element E of the j-th column. In FIG. 5, waveforms of the pulse width defining clock PCK are also shown corresponding to the driving signals Xj.

As shown in FIG. 5, each of the driving signals Xj that are supplied to the light-emitting elements E of the j-th column by the driving circuit 30 is a current signal having a waveform whose current value is first changed to an on current value Ion at the start point of the unit period U ($U_1$ or $U_2$), and is second changed from the on current value Ion to zero at a timing according to the gray-scale data DG[j] among a plurality of timings at which the pulse width defining clock PCK rises in the unit period U. However, when the gray-scale value assigned by the gray-scale data DG[j] is zero, the current value of the driving signal Xj becomes zero over the entire unit period U. In the unit period U, a time length at which the driving signal Xj keeps the on current value Ion becomes long as the gray-scale value of the gray-scale data DG[j] is large. As seen from FIG. 5, one cycle of the pulse width defining clock PCK may be a unit of a change in pulse width of the driving signal Xj (pitch).

The cycle $t_c$2 of the clock signal DCK1 in the second period $P_2$ is shorter than the cycle $t_c$1 in the first period $P_1$. Accordingly, as shown in the portions (1) and (2) of FIG. 4, in the pulse width defining clock PCK generated on the basis of the clock signal DCK1, the cycle $t_p$2 in the second period $P_2$ is shorter than the cycle $t_p$1 in the first period $P_1$. Therefore, even though the same gray-scale value is assigned in the first period $P_1$ and the second period $P_2$, a time length (pulse width) at which the driving signal Xj keeps the on current value Ion in the unit period $U_2$ of the second period $P_2$ is shorter than a time length at which the driving signal Xj keeps the on current value Ion in the unit period $U_1$ of the first period $P_1$. In this configuration, if the on current value Ion of the driving signal Xj is set to have the same current value in the first period $P_1$ and the second period $P_2$, even though the second gray-scale data DGb having inverted high and low levels with respect to those of the first gray-scale data DGa is generated, the degree of light-emission of light-emitting element E varies over the first period $P_1$ and the second period $P_2$ according to the content of the image data G. In this embodiment, the on current value Ion (hereinafter, also referred to as 'on current value Ib') of the driving signal Xj in the second period $P_2$ is set higher than the on current value Ion (hereinafter, also referred to as 'on current value Ia') in the first period $P_1$ by the current value setting unit 48 of FIG. 3.

The current value setting unit 48 determines the on current values Ion of the driving signals X1 to Xn according to the mode signal Smod. More specifically, the current value setting unit 48 outputs current value data DI for assigning the on current value Ia to the driving circuit 30 in the first period $P_1$ where the mode signal Smod is in the high level, and outputs current value data DI for assigning the current value Ib higher than the on current value Ia to the driving circuit 30 in the second period $P_2$ where the mode signal Smod is in the low level. Moreover, the detail relationship between the on current values Ion (Ia and Ib) will be described in details.

Figure 6:
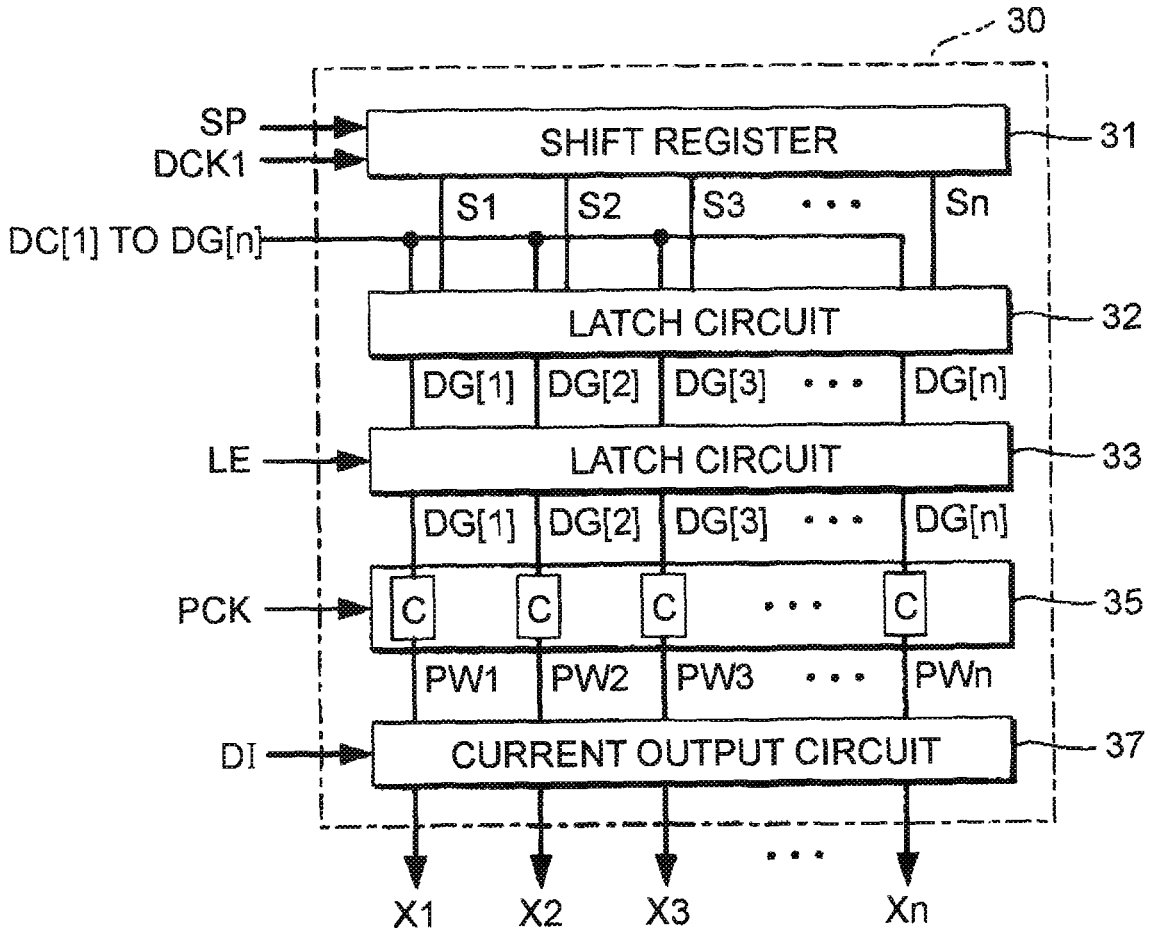
FIG. 6 is a block diagram snowing the specific configuration of a driving circuit.

Next, the specific configuration of the driving circuit 30 shown in FIG. 1 with reference to FIG. 6. In FIG. 6, a shift register 31, a latch circuit 32, and a latch circuit 33 perform parallel conversion of the n gray-scale data DG[1] to DG[n] to be supplied in serial from the controller 40 for each unit period U (U1, U2) (serial-parallel conversion) The shift register 31 is an n-bit shift register corresponding to the total number of the light-emitting elements E. The shift register 31 outputs the start pulse SP as sampling signals S1 to Sn by sequentially shifting the start pulse SP at a timing synchronized to the clock signal DCK1. Therefore, the sampling signals S1 to Sn sequentially become active for each one cycle ($t_c$1 or $t_c$2) of the clock signal DCK1.

The gray-scale data DG[1] to DG[n] are supplied in serial from the data processing unit 45 to the latch circuit 32. The latch circuit 32 samples the gray-scale data DG[j] and outputs the sampled gray-scale data at a timing at which the sampling signal Sj is changed to the active level. Therefore, the gray-scale data DG[1] to DG[n] are sequentially output to the latch circuit 33 for each one cycle of the clock signal DCK1. The gray-scale data DG[1] to DG[n] for one row that are sampled by the latch circuit 32 are simultaneously output from the latch circuit 33 at a timing at which the light-emission enable signal LE rises (see FIG. 4).

At the back of the latch circuit 33, a pulse driving circuit 35 is disposed. The pulse driving circuit 35 includes n unit circuits S corresponding to the total number of the light-emitting elements E. The pulse width defining clock PCK is supplied from the clock control unit 42 to the individual unit circuits C. The j-th unit circuit C outputs a pulse driving signal PWj having a pulse width according to the gray-scale data DG[j] to be supplied from the latch circuit 33. That is, as shown in the portions (1) and (2) of FIG. 4, the pulse driving signal PWj keeps the high level in a period from the start point of the unit period U until the time length according to the gray-scale data DG[j] (here, data assigning the gray-scale value '6') passes, and keeps the low level in a period after the time length according to the gray-scale data DG[j] to the end point of the unit period U. Like the driving signal Xj shown in FIG. 5, the level of the pulse driving signal PWj is changed from one of the high level and the low level to the other level at a timing at which the pulse width defining clock PCK rises.

A current output circuit 37 of FIG. 6 generates the driving signals X1 to Xn on the basis of the current value data supplied from DI the current value setting unit 48 and the pulse driving signals PW1 to PWn output from the pulse driving circuit 35. That is, the current output circuit 37 keeps the on current value Ion (the current value Ia or the current value Ib) represented by the current value data DI in a period where the pulse driving signal PWj is in the high level, and generates the driving signal Xj in a period where the pulse driving signal PWj is in the low level such that the current value becomes zero.

With the above-described configuration, as shown in the lowermost side of the portion (1) of FIG. 4, in the first period $P_1$, the driving signals X1 to Xn having the current value Ia (the on current value Ion) by the pulse width according to the first gray-scale data DGa are output for each unit period $U_1$. Further, as shown on the lowermost side of the portion (2) of FIG. 4, in the second period $P_2$, the driving signals X1 to Xn having the current value Ib (the on current value Ion) by the pulse width according to the second gray-scale data DGb are output for each unit period $U_2$.

As such, in this embodiment, the light-emitting elements E are driven on the basis of the first gray-scale data DGa in the first period $P_1$, and are driven on the basis of the second gray-scale data DGb having the inverted high and low level with respect to the gray-scale value of the first gray-scale data DGa in the second period $P_2$. According to this configuration, regardless of the content of the image data C (the first gray-scale data DGa), the sum of the degrees of light-emission (light-emission energy) over the first period $P_1$ and the second period $P_2$ can approximate to a predetermined value. Accordingly, the degrees of time-variant characteristic degradation are made uniform for the plurality of light-emitting elements E. Therefore, according to this embodiment, a variation of light amount of each light-emitting element E due to the difference in time-variant characteristic degradation can be suppressed.

In addition, in this embodiment, with driving according to the first gray-scale data DGa and driving according to the second gray-scale data DGb, the degrees of characteristic degradation of the light-emitting elements E are made uniform, and thus an accumulation value of the number of light-emission times of each light-emitting element E does not need to be held. Therefore, as compared with the configuration of Patent Document 1 or 2 where the accumulation value of the number of light-emission times for each light-emitting element E is held, a required storage capacity of the light-emitting device 10 is markedly reduced. For example, in this embodiment, the required storage capacity of the light-emitting device 10 is merely about '4 (bits)×m (rows)×n (columns)'. With the reduction in the storage capacity, the circuit size of the light-emitting device 10 can be reduced or manufacturing costs can be reduced.

Further, in this embodiment, the second period $P_2$ for adjusting the degree of degradation of the light-emitting element E is disposed in an interval (a so-called paper interval) between the first periods $P_1$ where the image according to exposure by the light-emitting device 10 is actually output. That is, even though the light-emitting elements E emit light in the second period $P_2$, light-emission does not have a direct effect on an original use of an image forming apparatus. Besides, since the second period $P_2$ is set to have the time length shorter than that of the first period $P_1$, a ratio of a time at which the image forming apparatus can be effectively used for the original use can be increased, as compared with a configuration where the first period $P_1$ and the second period $P_2$ have the same time length. That is, effective image formation (printing at a high speed) can be implemented. In addition, even though the pulse width of the driving signal Xj in the second period $P_2$ is set to have the time length shorter than that of the pulse width of the driving signal Xj in the first period $P_1$, the on current value Ib of the driving signal Xj in the second period $P_2$ is set to have the current value higher than the on current value Ia of the driving signal Xj in the first period $P_1$. Therefore, the degrees of light-emission over the first period $P_1$ and the second period $P_2$ can be made uniform at high accuracy for each light-emitting element E.

Figure 7:
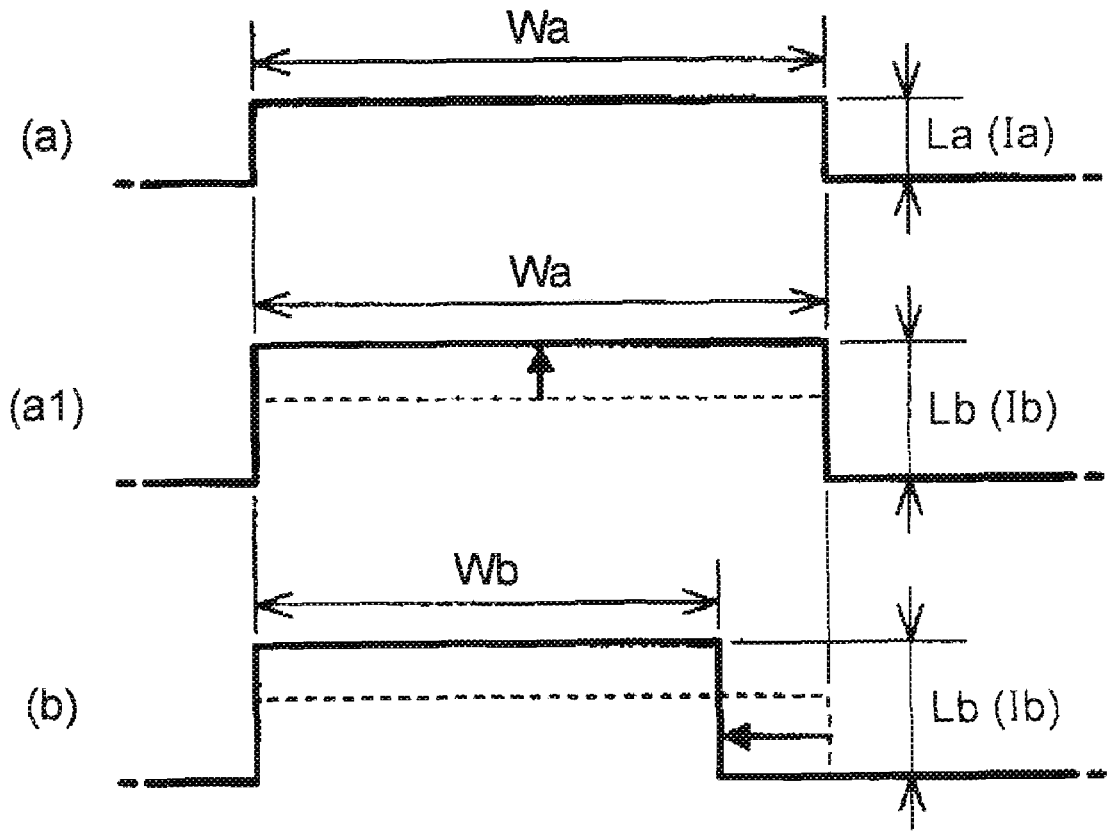
FIG. 7 is a timing chart illustrating a procedure for selecting a current value Ia and a current value Ib.

Next, a specific method of selecting the current value Ia and the current value Ib will be described with reference to FIG. 7. A portion (a) of FIG. 7 shows a state where the light-emitting element E emits light at intensity (peak light amount) La when the driving signal Xj of the on current value Ia·pulse width Wa corresponding to the gray-scale value g0 of the gray-scale data DG[j] (the first gray-scale data DGa[j]) is supplied in the first period $P_1$. Meanwhile, a portion (b) of FIG. 7 shows a state where the light-emitting element E emits light at intensity Lb upon supply of the driving signal Xj of the on current value Ib·the pulse width Wb when the same gray-scale value g0 is assigned by the gray-scale data DG[j] (the second gray-scale data DGb[j]) in the second period $P_2$.

The lifespan LT2 of the light-emitting element E when light-emission of the portion (b) of FIG. 7 is repeated for a long period will now be examined on the basis of the lifespan LT0 of the light-emitting element E when light-emission of the portion (a) of FIG. 7 is repeated for a long period. Moreover, the 'lifespan' of the light-emitting element E is a numerical value that serves as an index of a time-variant lowering speed of the characteristic (for example, light-emission efficiency) due to degradation of the light-emitting element E. In this embodiment, the 'lifespan' corresponds to a time length at which the intensity of light-emission of the light-emitting element E when a predetermined current is supplied is lowered from a measurement value immediately after manufacturing to a predetermined value (for example, about 80% of the intensity in an initial state).

First, as shown in a portion (a1) of FIG. 7, it is assumed that, while the pulse width Wa of the portion (a) of FIG. 7 is kept as it is, the on current value Ia of the driving signal Xj is changed (that is, increases) to the on current value Ib such that the intensity La increases to the intensity Lb (Lb>La). In this case, the lifespan LT1 of the light-emitting element E is expressed by the following equation (1).

$$LT1=LT0\times(Lb/La)^{-M} \quad (1)$$

In the equation (1), 'M' is a multiplier factor that is determined according to a material, a structure, or a manufacturing method of the light-emitting element E, for example, '2' or '3'. As seen from the equation (1), the lifespan LT1 of the light-emitting element E is in inverse proportion to an M power of the intensity Lb. That is, a speed of characteristic degradation of the light-emitting element E is in proportion to the M power of the intensity Lb.

Next, as shown in the portion (b) of FIG. 7, it is assumed that, while the intensity Lb of the portion (a1) of FIG. 7 is kept as it is, the pulse width Wa of the driving signal Xj is reduced to the pulse width Wb. In this case, the lifespan LT2 of the light-emitting element E is expressed by the following equation (2).

$$LT2=LT1\times(Wa/Wb) \quad (2)$$

As seen from the equation (2), the lifespan LT2 of the light-emitting element E is in inverse proportion to the pulse width Wb. That is, the characteristic of the light-emitting element E is being degraded at a speed proportional to the pulse width. As seen from the equations (1) and (2), the state of a change in electrical or optical characteristic of the light-emitting element E (a characteristic degradation speed) in this embodiment varies between a case where the on current value Ion changes while the pulse width of the driving signal Xj is kept as it is (the equation (1)) and a case where the pulse width changes while the on current value Ion of the driving signal Xj is kept as it is (the equation (2)).

Here, in order to equalize the degree of degradation (lifespan) in the case of the portion (a) and the case of the portion (b) of FIG. 7, the following equation should be established.

$$LT2=LT0 \quad (3)$$

If the equation (3) is substituted with the equations (1) and (2), the following equation (4) is deduced.

$$(Lb/La)^{-M}=(Wb/Wa) \quad (4)$$

Now, it is assumed that the cycle $t_p$2 of the pulse width defining clock PCK in the second period $P_2$ becomes '1/u' (u>1) times of the cycle $t_p$1 of the pulse width defining clock PCK in the first period $P_1$ (that is, the cycle $t_c$2 of the clock signal DCK1 in the second period $P_2$ becomes '1/u' times of the cycle $t_c$1 in the first period $P_1$). In this case, the pulse width Wb of the driving signal Xj when the gray-scale value g0 in the second period $P_2$ is assigned becomes '1/u' times of the pulse width Wa of the driving signal Xj corresponding to the same gray-scale value g0 of the first period $P_1$. That is, the following equation is established.

$$Wb=Wa/u \quad (5)$$

If the equation (5) is substituted for the equation (4), the following equation (6) is deduced.

$$Lb/La=u^{1/M} \quad (6)$$

In this embodiment, the on current value Ia in the in the first period $P_1$ and the on current value Ib in the second period $P_2$ are determined such that the intensity La and the intensity Lb satisfy the equation (6). As seen from the above-described deduction processing, by selecting a relative ratio of the on current value Ia and the on current value Ib from the equation (6), the degrees of degradation of each light-emitting element E over the first period $P_1$ and the second period $P_2$ can be made uniform with high accuracy.

<B: Modifications>

Various modifications can be made from the above-described embodiment. Specific modifications are illustrated as follows. Moreover, the following modifications may be appropriately combined.

(1) First Modification

In the above-described embodiment, on an assumption that the second period $P_2$ is set to the time length of 1/u times of the first period $P_1$, a procedure for selecting the on current value Ion (Ia or Ib) has been described. In contrast, on an assumption that the on current value Ia of the first period $P_1$ and the on current value Ib of the second period $P_2$ have a predetermined ratio, the time lengths of the first period $P_1$ and the second period $P_2$ may be determined. For example, it is assumed that the on current value Ib in the second period $P_2$ is set to be 'v', times of the on current value Ia in the first period $P_1$ such that the intensity Lb in the second period $P_2$ becomes 'v' (v>1) times of the intensity La in the first period $P_1$. In this case, the following equation is established.

$$Lb=v\times La \quad (7)$$

If the equation (7) is substituted for the equation (4) the following equation (8) is deduced.

$$Wb/Wa=v^{-M} \quad (8)$$

Therefore, the relative ratio of the pulse width Wa in the first period $P_1$ and the pulse width Wb in the second period $P_2$ (that is, the ratio of the cycle $t_p$1 of the pulse width defining clock PCK in the first period $P_1$ and the cycle $t_p$2 in the second period $P_2$) is determined so as to satisfy the equation (8).

(2) Second Modification

In the first embodiment, the configuration that the cycle of the pulse width defining clock PCK varies in the first period $P_1$ and the second period $P_2$ by the change in cycle of the clock signal DCK1 is illustrated, but the cycle of the clock signal DCK1 is not necessarily changed. That is, the pulse width defining clock PCK having the cycle $t_p$1 in the first period $P_1$, and the pulse width defining clock PCK having the cycle $t_p$2 in the second period $P_2$ may be generated by the timing control unit 47. According to this configuration, what is necessary is that, only for a part for generating the pulse width defining clock of the timing control unit 47 and the pulse driving circuit 35 of the driving circuit 30, a processing is changed in the first period $P_1$ and the second period $P_2$. Therefore, the configuration of the light-emitting device 10 is simplified, as compared with the above-described embodiment where the cycle of the clock signal DCK1 is changed. Moreover, in this modification, the data processing unit 45 outputs the gray-scale data DGC[1] to DC[n] to the driving circuit 30 at a timing synchronized to the clock signal DCK0 (cycle $t_c$1) supplied from the outside. However, in this configuration, the time length required for the output of the gray-scale data DG[1] to DG[n] synchronized to the clock signal DCK0 (at least the time length of 'cycle $t_c$1×n') needs to be secured in a section from the rising edge of the start pulse SP to a timing at which the light-emission enable signal LE rises.

(3) Third Modification

In the above-described embodiment, the configuration that the current having the on current value Ion is supplied from the driving circuit 30 to the light-emitting element E is illustrate (a current-driven type), but the driving circuit 30 may apply a voltage to the light-emitting element E so as to cause the light-emitting element E to emit light (a voltage-driven type). Further, in the above-described configuration, the configuration that the gray-scale level (the sum of the light-emission amount in the unit period U) of the light-emitting element E is controlled by adjusting the pulse width of the driving signal Xj, but a method of controlling the gray-scale level of the light-emitting element E may be arbitrarily selected. For example, the gray-scale level of the light-emitting element E may be controlled by adjusting the level of the driving signal Xj (current value or voltage value). Therefore, for example, in each of the unit periods $U_1$ of the first period $P_1$, the driving signal Xj having a level according to the first gray-scale data DGa may be output from the driving circuit 30. Further, in each of the unit periods $U_2$ of the second period $P_2$, the driving signal Xj having a level according to the second gray-scale data DGb may be output from the driving circuit 30. According to this configuration, even though the pulse width of the driving signal Xj is not changed in the first period $P_1$ and the second period $P_2$, a difference of time-variant change in characteristic of each light-emitting element E can be suppressed.

(4) Fourth Modification

The division of the individual elements shown in FIG. 3 or 6 as parts is arbitrarily changed. Specifically, the individual elements of FIG. 3 do not necessarily constitute one part (the controller 40), and the individual elements may be appropriately constituted by separate parts. For example, in FIG. 3, the configuration that the data processing unit 45 is incorporated into the controller 40 has been illustrated. However, a circuit for generating the first gray-scale data DGa and the second gray-scale data DGb may be disposed on a path from the controller 40 to the driving circuit 30 (on a path through which the gray-scale data DC is transmitted). Further, a circuit for generating the second gray-scale data Dab may be incorporated into the driving circuit 30. Alternatively, the controller 40 and the driving circuit 30 in the above-described embodiment may be mounted on one part (IC chip).

<C: Electronic Apparatus>

<C-1: Image Forming Apparatus>

Next, an image forming apparatus that is one example of an electronic apparatus according to the invention will be described with reference to FIG. 8. The image forming apparatus is a tandem-type full color image forming apparatus that uses a belt intermediate transfer member system.

In the image forming apparatus, four light-emitting devices 10K, 10C, 10M, and 10Y having the same configuration are respectively disposed at positions facing image formation surfaces of four photosensitive drums (image carriers) 110K, 110C, 110M, and 110Y having the same configuration. The light-emitting devices 10K, 10C, 10M, 10Y are the light-emitting device 10 according to the above-described embodiment.

Figure 8:
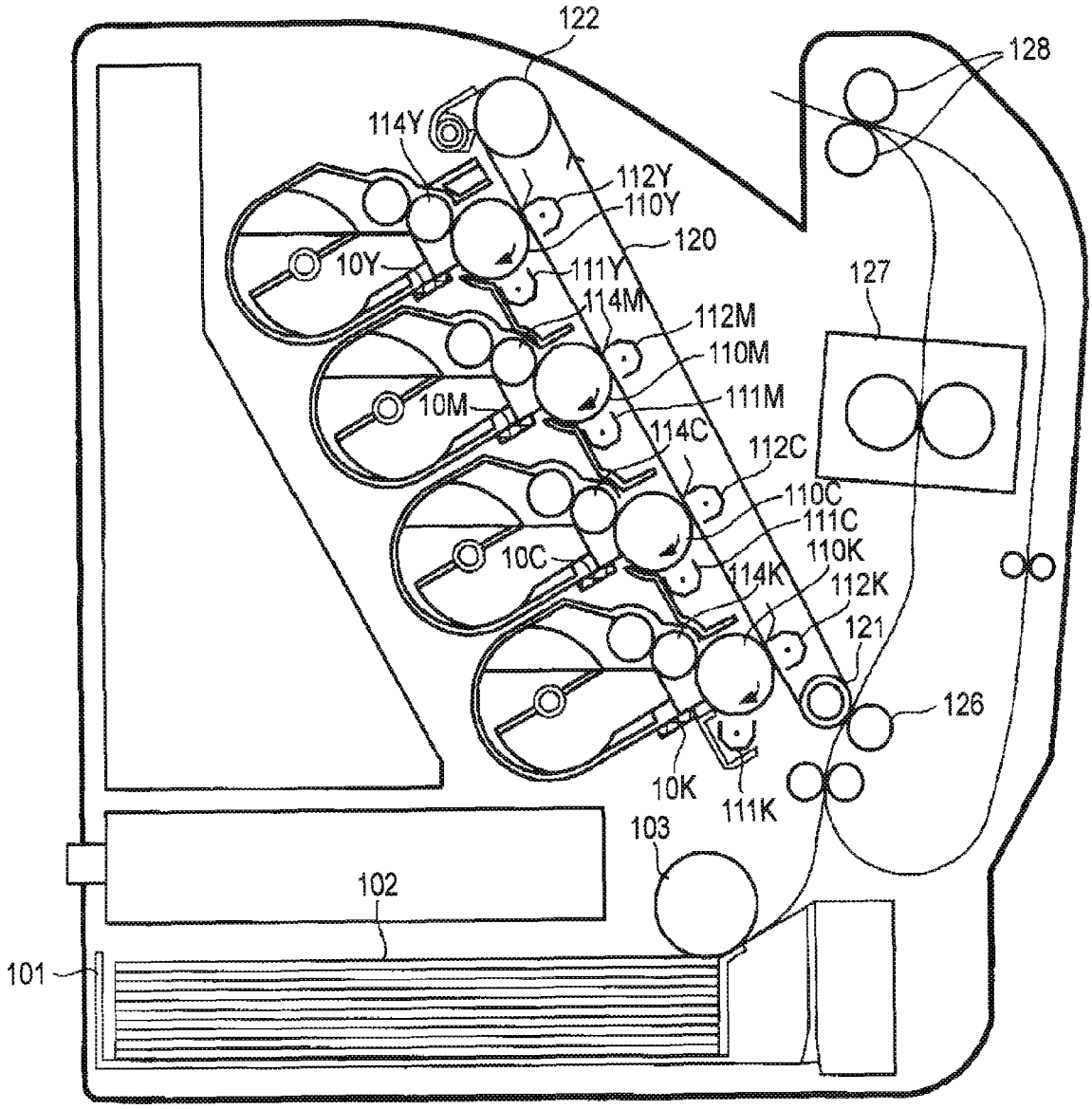
FIG. 8 is a perspective view showing a specific example (image forming apparatus) of an electronic apparatus according to an embodiment of the invention.

As shown in FIG. 8, in the image forming apparatus, a driving roller 121 and a driven roller 122 are provided, and an endless intermediate transfer belt winds on the rollers 121 and 122, and rotates around the rollers 121 and 122, as indicated by an arrow. Though not shown, a tension application unit, such as a tension roller or the like, that applies a tension to the intermediate transfer roller 120 may be provided.

In the periphery of the intermediate transfer belt 120, four photosensitive drums 110K, 110C, 110M, and 110Y having photosensitive layers on the circumferences are disposed at predetermined intervals. Symbols 'K', 'C', 'M', and 'Y' mean that the photosensitive drums 110K, 110C, 110M, and 110Y are respectively used to form apparent images of black, cyan, magenta, and yellow. The same is applied to other members. The photosensitive drums 110K, 110C, 110M, and 110Y rotate in synchronization with driving of the intermediate transfer belt 120.

Around each photosensitive drum 110 (K, C, M, or Y), a corona charger 111 (K, C, M, or Y), the light-emitting device 10 (K, C, M, or Y), and a developing device 114 (K, C, M, or Y) are disposed. The corona charger 111 (K, C, M, or Y) uniformly charges the image formation surface 110A (circumference) of the photosensitive drum 110 (K, C, M, or Y). The light-emitting device 10 (K, C, M, or Y) writes an electrostatic latent image on the charged image formation surface 110A of each photosensitive drum. In each light-emitting device 10 (K, C, M, or Y), a plurality of light-emitting elements E are arranged along a main bus (main scanning direction) of the photosensitive drum 110 (K, C, M, or Y). Writing of the electrostatic latent image is performed by irradiating light onto the photosensitive drum 110 (K, C, M, or Y) using the plurality of light-emitting elements E. The developing device 114 (K, C, M, or Y) attaches a toner serving as a developing agent to the electrostatic latent image so as to form an apparent image (that is, a visual image) on the photosensitive drum 110 (K, C, M, or Y).

The apparent images of black, cyan, magenta, and yellow formed by such monochrome apparent image formation steps for four colors are primarily transferred on the intermediate transfer belt 120 in sequence and overlap one another on the intermediate transfer belt 120. As a result, full color apparent images are formed. Four primary transfer corotrons (transfer devices) 112 (K, C, M, and Y) are disposed in the intermediate transfer belt 120. The primary corotrons 112 (K, C, M, and Y) are respectively disposed in the vicinities of the photosensitive drum 110 (K, C, M, and Y), and transfer the apparent images to the intermediate transfer belt 120 passing between the photosensitive drums and the primary transfer corotrons by electrostatically absorbing the apparent images from the photosensitive drums 110 (K, C, M, and Y).

A sheet 102 serving as a subject (recording medium), on which an image is finally formed, is fed from a paper feed cassette 101 by a pickup roller 103 one by one, and is then fed to a nip between the intermediate transfer belt 120 in contact with the driving roller 121 and the secondary transfer roller 126. The full color apparent images on the intermediate transfer belt 120 are collectively secondarily transferred to one surface of the sheet 102 by a secondary transfer roller 126, and then are fixed on the sheet 102 when the sheet 102 passes through a pair of fixing rollers 127 serving as a fixing device. Then, the sheet 102 is discharged on a discharge cassette, which is provided on an upper portion of the apparatus, by a pair of discharge rollers 128.

Figure 9:
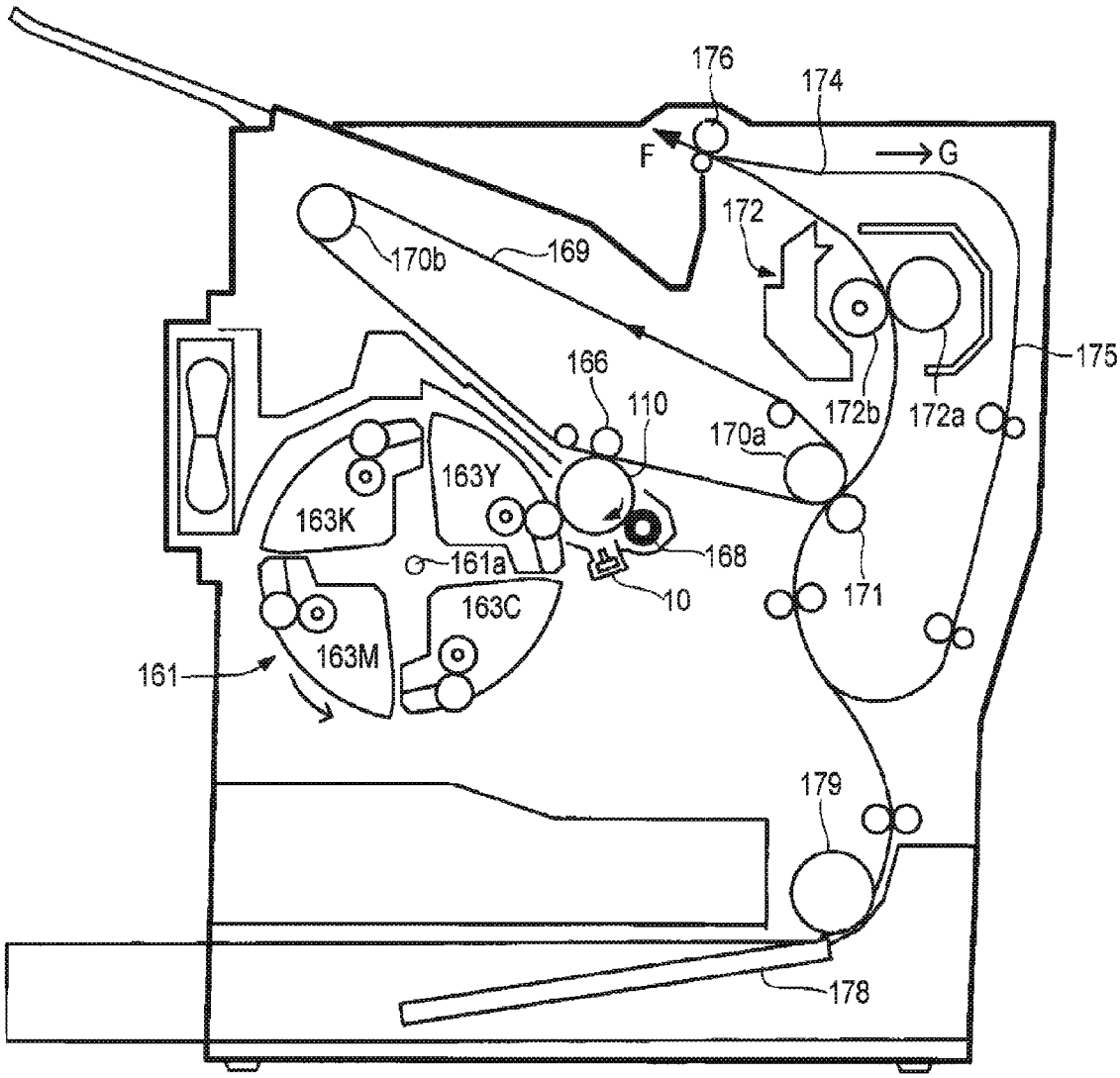
FIG. 9 is a perspective view showing a specific example (image forming apparatus) of an electronic apparatus according to an embodiment of the invention.

Next, another example of an image forming apparatus according to the invention will be described with reference to FIG. 9. The image forming apparatus is a rotary development-type full color image forming apparatus that uses a belt intermediate transfer member system. As shown in FIG. 9, in the vicinity of the photosensitive drum 110, a corona charger 168, a rotary-type developing unit 161, the light-emitting device 10 according to the above-described embodiment, and an intermediate transfer belt 169 are provided.

The corona charger 163 uniformly charges the circumference of the photosensitive drum 110. The light-emitting device 10 writes an electrostatic latent image on a charged image formation surface 110A (circumference) of the photosensitive drum 110. In the light-emitting device 10, a plurality of light-emitting elements E are arranged along a main bus of the photosensitive drum 110 (in a main scanning direction). Writing of the electrostatic latent image is performed by causing light to be irradiated from the light-emitting elements E onto the photosensitive drum 110.

The developing unit 161 is a dream that has four developing devices 163Y, 163C, 163M, and 163K arranged at angular intervals of 90°. The developing unit 161 can rotate in a counterclockwise direction around a shaft 161*a*. The developing devices 163Y, 163C, 163M, 163K respectively supply toners of yellow, cyan, magenta, and black to the photosensitive drum 110, and form an apparent image (that is, visual image) on the photosensitive drum 110 by attaching the toners serving as developing agents to the electrostatic latent image.

An endless intermediate transfer belt 169 winds on a driving roller 170*a*, a driven roller 170*b*, a primary transfer roller 166, and a tension roller, and rotates around the vicinities of the rollers in a direction indicated by an arrow. The primary transfer roller 166 transfers the apparent image to the intermediate transfer belt 169 passing between the photosensitive drum 110 and the primary transfer roller 166 by electrostatically absorbing the apparent image from the photosensitive drum 110.

Specifically, with the first one rotation of the photosensitive drum 110, the electrostatic latent image for a yellow (Y) image is written by the light-emitting device 10, and the apparent image of the same color is formed by the developing device 163Y and is then transferred to the intermediate transfer belt 169. Further, with the next one rotation, the electrostatic latent image for a cyan (C) image is written by the light-emitting device 10, and the apparent image of the same color is formed by the developing device 163C and is then transferred to the intermediate transfer belt 169 so as to overlap the apparent image of yellow. During the photosensitive drum 110 rotates four times in such a manner, the apparent images of yellow, cyan, magenta, and black sequentially overlap on the intermediate transfer belt 169. As a result, the full color apparent images are formed on the transfer belt 169. When an image is formed on both surfaces of the sheet serving as a subject, on which the image is finally formed, the apparent images of the same color for both surfaces are transferred to the intermediate transfer belt 169. Then, the full color apparent images are formed on the intermediate transfer belt 169 by transferring the apparent images of the next color for both surfaces to the intermediate transfer belt 169.

In the image forming apparatus, a sheet feed path 174, through which the sheet passes, is provided. The sheets are fed from a discharge cassette 178 by a pickup roller 179 one by one, travels the sheet feed path 174 by a feed roller, and passes through a nip between an Intermediate transfer belt 169 in contact with a driving roller 170*a* and a secondary transfer roller 171. The secondary transfer roller 171 transfers the apparent images to one surface of the sheet by collectively and electrostatically absorbing the full color apparent images from the intermediate transfer belt 169. The secondary transfer roller 171 approaches or moves away from the intermediate transfer belt 169 by a clutch (not shown). Then, when the full color apparent images are transferred to the sheet, the secondary transfer roller 171 comes into contact with the intermediate transfer belt 169. Meanwhile, the secondary transfer roller 171 is separated from the secondary transfer roller 171 when the apparent images overlap on the intermediate transfer belt 169.

The sheet on which the images are transferred in such a manner is fed to a fixing device 172, and the apparent images on the sheet are fixed when the sheet passes through a heating roller 172*a* and a pressing roller 172*b* of the fixing device 172. After fixing, the sheet is pulled between a pair of discharge rollers 176 and moves in a direction of an arrow F. When double printing, most of the sheet passes through the pair of discharge rollers 176, and then is introduced into a two-sided printing feed path 175, as indicated by an arrow G, by the reverse rotation of the pair of discharge rollers 176. Next, the apparent images are transferred to the other surface of the sheet by the secondary transfer roller 171. After fixing is performed by the fixing device 172 again, the sheet is discharged by the pair of discharge rollers 176.

The image forming apparatus shown in FIGS. 8 and 9 uses a light source (an exposure device) having OLED elements as the light-emitting elements E, and thus the apparatus can be reduced in size, as compared with a case where a laser scanning optical system is used. Moreover, the light-emitting device of the invention can be used in an electrophotographic image forming apparatus, in addition to the above-described image forming apparatus. For example, the light-emitting device according to the invention can be used in an image forming apparatus that directly transfers an apparent image to a sheet from a photosensitive drum, without using an intermediate transfer belt, or an image forming apparatus that forms a monochrome image.

<C-2: Others>

In the above description, the light-emitting device that is used as an exposure head has been illustrated, but the use of the light-emitting device of the invention is not limited to exposure of a photosensitive member. For example, the light-emitting device of the invention is used in an image reading apparatus, such as a scanner or the like, as a linear optical head (an illumination device) that irradiates light on a subject to be read, such as an original or the like. Such an image reading apparatus includes a scanner, a reading part of a copy machine or a facsimile machine, a bar code reader, or a two-dimensional image code reader that reads a two-dimensional image code, such as a QR code (Registered Trademark). Further, a light-emitting device that has a plurality of light-emitting elements arranged in a planar shape is used as a backlight that is disposed on the back side of a liquid crystal panel.

As a display device for displaying an image, the light-emitting device according to the embodiment of the invention is used. In this display device, a plurality of light-emitting elements E are arranged in a matrix shape over a row direction and a column direction. Then, a scanning line driving circuit selects each row for each unit period (horizontal scanning period), and a driving signal Xj is supplied to the individual light-emitting elements E of the selected row from the driving circuit 30. An electronic apparatus in which the light-emitting device according to the embodiment of the invention is used to display the images includes, for example, a portable personal computer, a cellular phone, a personal digital assistant (PDA), a digital still camera, a television, a video camera, a car navigation device, a pager, an electronic organizer, an electronic paper, an electronic calculator, a word processor, a workstation, a video phone, a POS terminal, a printer, a scanner, a copy machine, a video player, an apparatus having a touch panel.

The entire disclosure of Japanese Patent Application No. 2005-328487, filed Nov. 14, 2005 is expressly incorporated by reference herein.

What is claimed is:

1. A light-emitting device comprising:

a plurality of light-emitting elements, each emitting light with a light amount according to a driving signal;

a storage unit that stores first gray-scale data for assigning a gray-scale value of each of the plurality of light-emitting elements;

a data processing unit that generates second gray-scale data from the first gray-scale data stored in the storage unit for each light-emitting element such that, under a condition that the gray-scale magnitude assigned by the first gray-scale data is large, a gray-scale magnitude assigned by the second gray-scale data is made small and under a condition that the gray-scale magnitude assigned by the first gray-scale data is small, the gray-scale magnitude assigned by the second gray-scale data is made large; and a non-symmetrical driving unit that causes the individual light-emitting elements to emit light in a first period upon supply of a driving signal according to the first gray-scale data stored in the storage unit, and causes the individual light-emitting elements to emit light in a second period different from the first period upon supply of a driving signal according to the second gray-scale data generated by the data processing unit, wherein a sum of the gray-scale magnitude of the first gray-scale data and the gray-scale magnitude of the second gray-scale data for each light-emitting element is substantially equal.

2. The light-emitting device according to claim 1, wherein the first period is a period where an image according to light-emission by each of the light-emitting elements is output, and the second period is a period where the image according to light-emission by each of the light-emitting elements is not output.

3. The light-emitting device according to claim 1, wherein the second period is shorter than the first period.

4. The light-emitting device according to claim 3, wherein the driving signal supplied to each light-emitting element becomes a level for causing the light-emitting element to emit light by a pulse width according to the first gray-scale data of a first unit period in the first period, and becomes a level for causing the light-emitting element to emit light by a pulse width according to the second gray-scale data of a second unit period shorter than the first unit period in the second period.

5. The light-emitting device according to claim 4, wherein the driving signal supplied to each light-emitting element becomes a level for causing the light-emitting element to emit light with a first light amount in a pulse width according to the first gray-scale data of the first unit period, and becomes a level for causing the light-emitting element to emit light with a second light amount larger than the first light amount in a pulse width of the second gray-scale data of the second unit period.

6. The light-emitting device according to claim 5, wherein each light-emitting element has different states of a time-variant change in characteristic when a level of the driving signal is fixed and a pulse width is changed, and when the pulse width of the driving signal is fixed and the level is changed, and the pulse width and the level of the driving signal according to the second gray-scale data are set such that the state of the time-variant change in characteristic of the light-emitting element when the driving signal according to the second gray-scale data assigning a predetermined gray-scale value is supplied approximately matches with the state of the time-variant change in characteristic of the light-emitting element when the driving signal according to the first gray-scale data assigning the predetermined gray-scale value is supplied.

7. The light-emitting device according to claim 6, wherein a time-variant lowering speed of the light amount of each light-emitting element is approximately in proportion to the pulse width of the driving signal and to an M power (where M is a real number) of the level of the driving signal, and when the light-emitting element having a predetermined gray-scale value assigned by the first gray-scale data emits light with a light amount La upon supply of a driving signal having a pulse width Wa, the level of the driving signal according to the second gray-scale data is determined such that a light amount Lb of the light-emitting element to which a driving signal having a pulse width Wa/u (where u>1) according to the second gray-scale data assigning the predetermined gray-scale value satisfies the equation $Lb/La=u^{1/M}$.

8. The light-emitting device according to claim 6, wherein a time-variant lowering speed of the light amount of each light-emitting element is approximately in proportion to the pulse width of the driving signal and to an M power (where M is a real number) of the level of the driving signal, and when the light-emitting element having a predetermined gray-scale value assigned by the first gray-scale data emits light with a light amount La upon supply of a driving signal having a pulse width Wa, a pulse width Wb of a driving signal that has a level determined so as to cause the light-emitting element to emit light with a light amount La×v (where v>1) according to the second gray-scale data assigning the predetermined gray-scale value satisfies the equation $Wb/Wa=v^{-M}$.

9. An electronic apparatus comprising the light-emitting device according to claim 1.

10. An image forming apparatus comprising:

an image carrier having an image formation surface, on which a latent image is formed by exposure;

light-emitting device according to claim 1 that exposes the image formation surface by selective light-emission of each light-emitting element; and a developing device that forms an apparent image by attaching a developing agent to the latent image, wherein the first period is a period where the developing device forms the apparent image from the latent image on the image carrier by light-emission of each light-emitting element in that period, and the second period is a period, a gap between previous and next first periods, where the apparent image according to light-emission of each light-emitting element in that period is not formed.

11. The light-emitting device according to claim 1, wherein the first gray-scale data is first, binary gray-scale data, the second gray-scale data is second, binary gray-scale data, and the data processing unit generates the second, binary gray-scale data from the first, binary gray-scale data, the second, binary gray-scale data being obtained by inverting each bit of the first, binary gray-scale data.

12. A method of driving a light-emitting device, which has a plurality of light-emitting elements each emitting light with a light amount according to a driving signal, the method comprising:

acquiring first gray-scale data assigning a gray-scale value of each of the plurality of light-emitting elements;

generating second gray-scale data from the acquired first gray-scale data for each light-emitting element such that, under a condition that the gray-scale magnitude assigned by the first gray-scale data is large, the gray-scale magnitude assigned by the second gray-scale data is made small and under a condition that the gray-scale magnitude assigned by the first gray-scale data is small, the gray-scale magnitude assigned by the second gray-scale data is made large; and causing each light-emitting element to emit light upon supply of a driving signal according to the acquired first gray-scale data in a first period, and causing each light-emitting element to emit light upon supply of a driving signal according to the generated second gray-scale data in a second period different from the first period, wherein a sum of the gray-scale magnitude of the first gray-scale data and the gray-scale magnitude of the second gray-scale data for each light-emitting element is substantially equal.

13. The light-emitting device according to claim 2, wherein the second period is shorter than the first period.

14. The light-emitting device according to claim 13, wherein the driving signal supplied to each light-emitting element becomes a level for causing the light-emitting element to emit light by a pulse width according to the first gray-scale data of a first unit period in the first period, and becomes a level for causing the light-emitting element to emit light by a pulse width according to the second gray-scale data of a second unit period shorter than the first unit period in the second period.

15. The light-emitting device according to claim 14, wherein the driving signal supplied to each light-emitting element becomes a level for causing the light-emitting element to emit light with a first light amount in a pulse width according to the first gray-scale data of the first unit period, and becomes a level for causing the light-emitting element to emit light with a second light amount larger than the first light amount in a pulse width of the second gray-scale data of the second unit period.

16. The light-emitting device according to claim 15, wherein each light-emitting element has different states of a time-variant change in characteristic when a level of the driving signal is fixed and a pulse width is changed, and when the pulse width of the driving signal is fixed and the level is changed, and the pulse width and the level of the driving signal according to the second gray-scale data are set such that the state of the time-variant change in characteristic of the light-emitting element when the driving signal according to the second gray-scale data assigning a predetermined gray-scale value is supplied approximately matches with the state of the time-variant change in characteristic of the light-emitting element when the driving signal according to the first gray-scale data assigning the predetermined gray-scale value is supplied.

17. The light-emitting device according to claim 16, wherein a time-variant lowering speed of the light amount of each light-emitting element is approximately in proportion to the pulse width of the driving signal and to an M power (where M is a real number) of the level of the driving signal, and when the light-emitting element having a predetermined gray-scale value assigned by the first gray-scale data emits light with a light amount La upon supply of a driving signal having a pulse width Wa, the level of the driving signal according to the second gray-scale data is determined such that a light amount Lb of the light-emitting element to which a driving signal having a pulse width Wa/u (where u>1) according to the second gray-scale data assigning the predetermined gray-scale value satisfies the equation $Lb/La=u^{1/M}$.

18. The light-emitting device according to claim 17, wherein a time-variant lowering speed of the light amount of each light-emitting element is approximately in proportion to the pulse width of the driving signal and to an M power (where M is a real number) of the level of the driving signal, and when the light-emitting element having a predetermined gray-scale value assigned by the first gray-scale data emits light with a light amount La upon supply of a driving signal having a pulse width Wa, a pulse width Wb of a driving signal that has a level determined so as to cause the light-emitting element to emit light with a light amount La×v (where v>1) according to the second gray-scale data assigning the predetermined gray-scale value satisfies the equation $Wb/Wa=v^{-M}$.

* * * * *